US006162016A

United States Patent [19]

Humbad

[11] Patent Number: 6,162,016

[45] Date of Patent: Dec. 19, 2000

[54] CENTRIFUGAL BLOWER ASSEMBLY

[75] Inventor: Niranjan Humbad, Novi, Mich.

[73] Assignee: Visteon Global Technologies, Inc., Dearborn, Mich.

[21] Appl. No.: 09/408,057

[22] Filed: Sep. 29, 1999

[51] Int. Cl.[7] ..... F04D 17/08

[52] U.S. Cl. ..... 415/204; 415/212.1; 415/119

[58] Field of Search ..... 415/119, 204, 415/206, 203, 211.1, 211.2, 212.1, 214.1

[56] References Cited

U.S. PATENT DOCUMENTS

| | | | |
|---|---|---|---|
| 3,684,396 | 8/1972 | Ball et al. . | |
| 3,687,360 | 8/1972 | Prew et al. . | |
| 3,824,028 | 7/1974 | Zenkner et al. | 415/53 |
| 4,078,870 | 3/1978 | Keller et al. . | |
| 5,746,577 | 5/1998 | Ito et al. . | |
| 5,813,831 | 9/1998 | Matsunaga et al. . | |
| 5,839,879 | 11/1998 | Kameoka et al. . | |

FOREIGN PATENT DOCUMENTS

| | | |
|---|---|---|
| 58-122394 | 7/1983 | Japan . |

*Primary Examiner*—Edward K. Look
*Assistant Examiner*—Liam McDowell
*Attorney, Agent, or Firm*—Larry I. Shelton

[57] ABSTRACT

A centrifugal blower assembly including a fan wheel and a housing enclosing the fan wheel. The housing has an inlet housing cover and an exit housing cover forming a volute chamber with a cut-off region and terminating in a fluid exit end. The inlet housing cover has a sidewall with an inlet aperture extending therethrough and a volute peripheral wall defining an interior surface of the volute chamber, and a wedge extending from the interior surface of the volute peripheral wall near the cut-off region to the sidewall adjacent the inlet aperture.

20 Claims, 3 Drawing Sheets

FIG 1
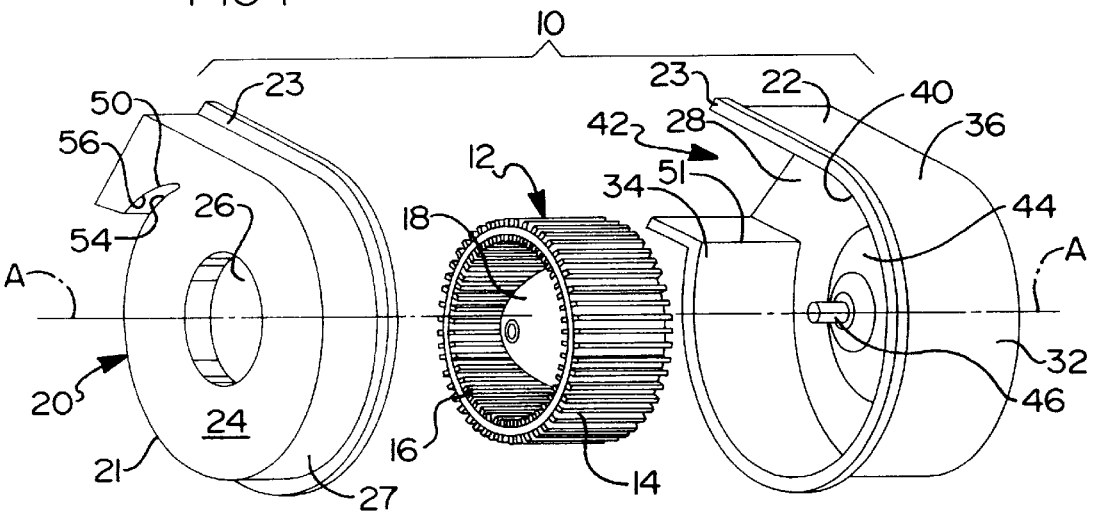
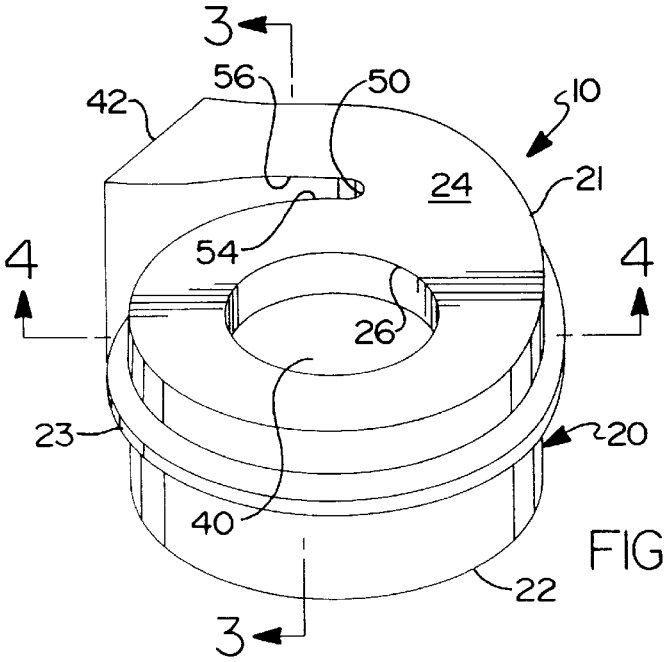
FIG 2

FIG 3
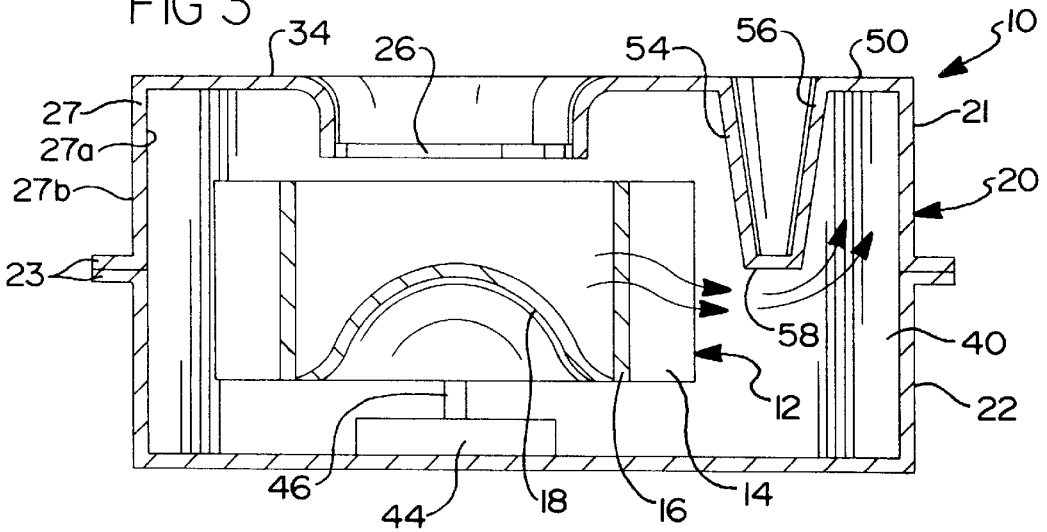
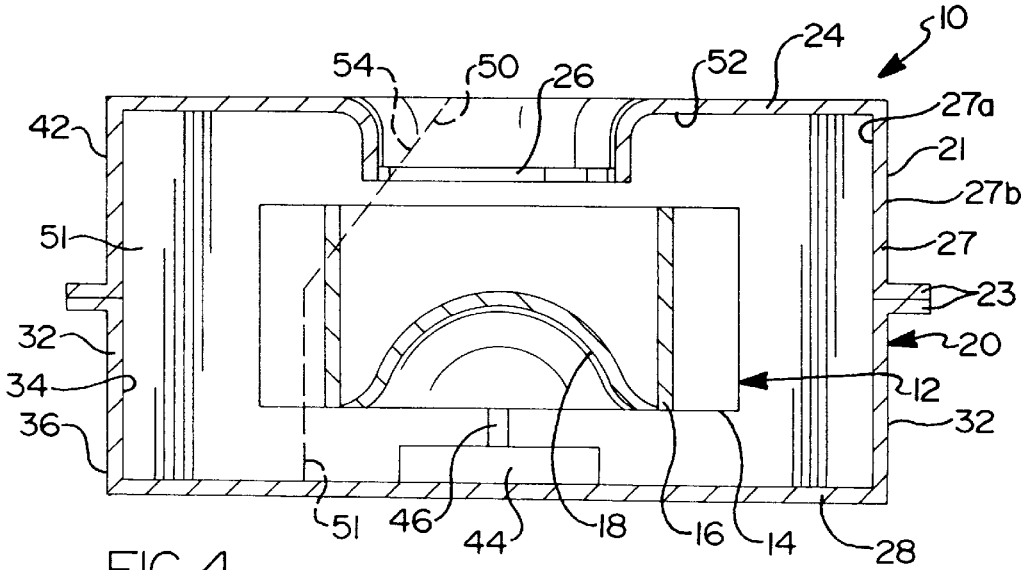
FIG 4

CENTRIFUGAL BLOWER ASSEMBLY

BACKGROUND OF THE INVENTION

1. Field of the Invention

The present invention relates generally to a centrifugal fan, blower or the like, and more specifically, to a centrifugal blower assembly that reduces rumble noise generated during operation.

2. Description of the Related Art

Centrifugal fans or blowers are commonly used in the automotive, air handling and ventilation industries for directing a forced flow of air through a variety of air conditioning components. In a typical centrifugal blower, air is drawn into a housing through an inlet aperture by a rotating blower or fan. This air is then forced around the housing and out an air exit end. Back pressure causes airflow re-circulation back across the cut-off region, causing a rumble noise when the difference in pressure is large near the inlet aperture between exit flow and inlet flow. Various modifications to the housing have been proposed for reducing noise.

Therefore, it is desirable to reduce airflow re-entering back into the fan wheel near the cut-off region, thereby reducing low rumble noise. It is further desirable to reduce noise in the centrifugal blower in an economical manner without affecting the performance of the centrifugal blower.

SUMMARY OF THE INVENTION

Accordingly, the present invention is a centrifugal blower assembly including a fan wheel and a housing enclosing the fan wheel. The housing has an inlet housing cover and an exit housing cover forming a volute chamber with a cut-off region and terminating in a fluid exit end. The inlet housing cover has a sidewall with an inlet aperture extending therethrough and a volute peripheral wall defining an interior surface of the volute chamber, and a wedge extending from the interior surface of the volute peripheral wall near the cut-off region to the sidewall adjacent the inlet aperture.

One advantage of the present invention is that a centrifugal blower assembly has a housing for a centrifugal blower that reduces rumble noise. A primary advantage of the present invention is that the centrifugal blower assembly has an inlet housing cover with a wedge to reduce airflow re-entering back into the fan wheel near the cut-off region of the housing, thereby reducing low rumble noise. A secondary advantage of the present invention is that the centrifugal blower assembly reduces tonal noise without degrading performance in a very manufacturable and economic manner.

Other features and advantages of the present invention will be readily appreciated as the same becomes better understood after reading the subsequent description when considered in connection with the accompanying drawings.

BRIEF DESCRIPTION OF THE DRAWINGS

FIG. 1 is an exploded perspective view of a centrifugal blower assembly, according to the present invention.

FIG. 2 is a perspective view of the centrifugal blower assembly of FIG. 1.

FIG. 3 is a sectional view taken along line 3—3 of FIG. 2.

FIG. 4 is a sectional view taken along line 4—4 of FIG. 2.

DESCRIPTION OF THE PREFERRED EMBODIMENT(S)

Figure 5:
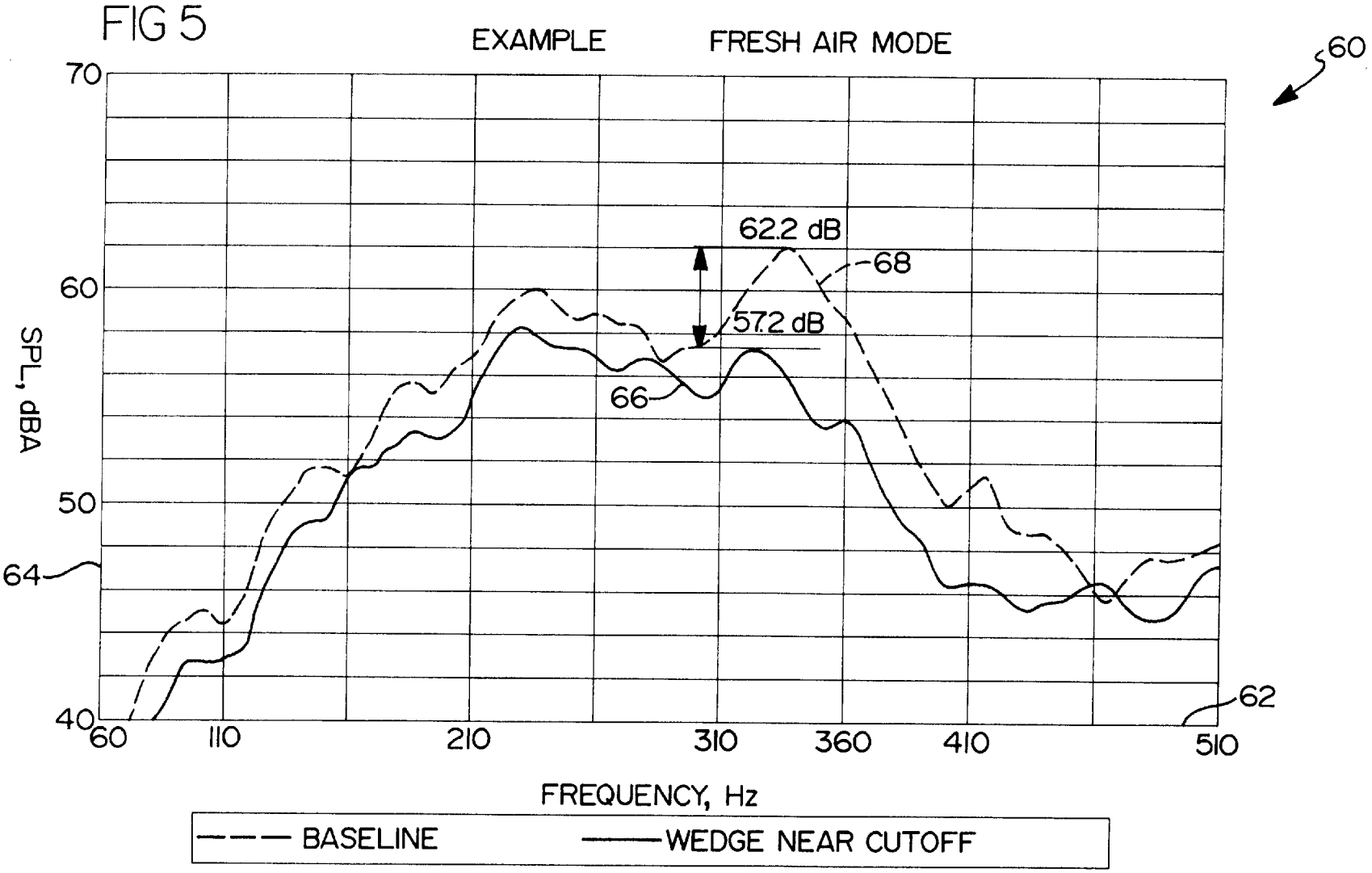
FIG. 5 is a graph of a fresh air mode for the centrifugal blower assembly of FIG. 1.

Referring to the drawings and in particular FIG. 1, one embodiment of a centrifugal blower assembly 10, according to the present invention, is shown for a motor vehicle (not shown). The centrifugal blower assembly 10 includes a fan wheel, generally indicated at 12, having a plurality of fan blades 14 disposed around an inlet ring 16 and a hub 18 of the fan wheel 12. It should be appreciated that the fan wheel 12 is conventional and known in the art.

The centrifugal blower assembly 10 also includes a housing, according to the present invention and generally indicated at 20, for enclosing the fan wheel 12. The housing 20 is defined by two housing parts, an inlet housing cover 21 and an exit housing cover 22 which are joined together at a peripheral lip 23 extending around the circumference of each. The inlet housing cover 21 includes a sidewall 24 having an inlet aperture 26 through which a volume of air is drawn by the fan wheel 12 to provide a volume of air through different heating, ventilation, and air conditioning components found within a plenum of the motor vehicle. The inlet housing cover 21 also includes a volute peripheral wall 27 extending generally perpendicularly from the sidewall 24 and having an interior surface 27*a* and an exterior surface 27*b*.

The exit housing cover 22 includes a sidewall 28 which may include an aperture (not shown) through which a motor 44 to be described may be placed for cooperating engagement with the fan wheel 12. The exit housing cover 22 includes a volute peripheral wall 32 extending generally perpendicularly from the sidewall 28 and having an interior surface 34 and an exterior surface 36. The volute peripheral walls 27, 32 and the sidewalls 24, 28 define volute chamber 40 and an exit end 42 through which the air passes into or toward the heating, ventilation, and air conditioning components in the plenum.

The centrifugal blower assembly 10 further includes a motor 44 having a shaft 46 which engages the fan wheel 12 to cause the fan wheel 12 to rotate or spin, thus drawing air in through the inlet aperture 26 of the housing 20 around the volute chamber 40 and through the exit end 42 of the housing 20. The motor shaft 46 defines an axis A—A coincident with the axis of rotation of the fan wheel 12. It should be appreciated that the motor 44 is connected to a source of power (not shown) and is conventional and known in the art.

Referring to FIGS. 1 through 4, the centrifugal blower assembly 10 further includes a wedge 50 formed in the inlet housing cover 21. The wedge 50 extends from the cut-off region 51 of the housing 20 upwardly and radially inwardly from the interior surface 27*a* of the volute peripheral wall 27 to an interior surface 52 of the sidewall 24 adjacent the inlet aperture 26. The wedge 50 has a first sidewall 54 and a second sidewall 56 that are inclined and a bottom wall 58 interconnecting the first sidewall 54 and second sidewall 56 to form a generally "V" shaped cross-section. The wedge 50 has a generally triangular shaped profile and is formed as a curve extending inwardly in a peripheral direction. The wedge 50 extends in the inlet housing cover 21 only past the cut-off region 51 of the housing 20 to reduce rumble noise due to less flow re-circulation generated by the blades 14 of the fan wheel 12. As illustrated in FIG. 3, the airflow as represented by the arrows traverses under the wedge 50 and out the exit end 42 and is prevented from re-circulating back to the fan wheel 12. It should be appreciated that the pressure of the airflow leaving the fan wheel 12 is higher than the pressure near the inlet aperture 26.

The first sidewall 54, second sidewall 56 and bottom wall 58 are formed as a monolithic structure being integral, unitary and one-piece. Preferably, the wedge 50 is molded integrally with the inlet housing cover 21 while that part is being fabricated. Alternatively, the wedge 50 can be secured mechanically to the interior surface 27*a* with such known fastening techniques as gluing or screwing. It should be appreciated that optimization of the shape and placement of the wedge member 50 will be dependent on many factors, including size of the housing, the volume of air passing through the housing, the speed of the fan wheel as well as blade configuration and cut-off geometry.

Referring to FIG. 5, a graph 60 of frequency versus noise is shown for a fresh air mode of the centrifugal blower assembly 10. As illustrated, frequency in hertz (Hz) is shown along an X-axis 62 and noise in decibels (dBA) is shown along a Y-axis 64. The graph 60 shows a curve 66 for the centrifugal blower assembly 10 and a curve 68 for a baseline or conventional centrifugal blower assembly without the wedge. As shown, the curve 66 is lower for the centrifugal blower assembly 10 compared to the curve 68 for the baseline centrifugal blower assembly, thereby indicating a reduction in a peak level of noise.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A centrifugal blower assembly comprising:

a fan wheel;

a housing enclosing said fan wheel, said housing having an inlet housing cover and an exit housing cover forming a volute chamber with a cut-off region and terminating in a fluid exit end, said inlet housing cover having a sidewall with an inlet aperture extending therethrough and a volute peripheral wall defining an interior surface of said volute chamber, and a wedge extending only between said interior surface of said volute peripheral wall near said cut-off region and said sidewall adjacent said inlet aperture.

2. A centrifugal blower assembly as set forth in claim 1 wherein said wedge is generally triangular in shape.

3. A centrifugal blower assembly as set forth in claim 1 wherein said wedge has a generally V-shaped cross-section.

4. A centrifugal blower assembly as set forth in claim 1 wherein said wedge comprises a first sidewall, a second sidewall and a bottom wall interconnecting said first side wall and said second sidewall, said first sidewall and said second sidewall being inclined toward said bottom wall.

5. A centrifugal blower assembly as set forth in claim 4 wherein said first sidewall, said second sidewall, and said bottom wall are integral, unitary and one-piece.

6. A centrifugal blower assembly as set forth in claim 1 wherein said wedge and said sidewall are integral, unitary and one-piece.

7. A centrifugal blower assembly as set forth in claim 1 wherein said wedge extends from said cut-off region upwardly and peripherally to said sidewall.

8. A centrifugal blower assembly as set forth in claim 1 wherein said wedge extends radially in a peripheral direction on an arcuate path.

9. A centrifugal blower assembly as set forth in claim 1 wherein said inlet housing cover and exit housing cover are joined to each other along opposing peripheral edges at a radial plane and wherein said wedge is secured to said inlet housing cover.

10. A centrifugal blower assembly as set forth in claim 1 wherein said fan wheel has an inlet ring and a plurality of fan blades disposed around said inlet ring.

11. A centrifugal blower assembly as set forth in claim 1 wherein said inlet housing cover and said exit housing cover are made of a plastic material.

12. A centrifugal blower assembly comprising:

a fan wheel;

a housing enclosing said fan wheel, said housing having an inlet housing cover and an exit housing cover forming a volute chamber with a cut-off region and terminating in a fluid exit end, said inlet housing cover having a sidewall with an inlet aperture extending therethrough and a volute peripheral wall defining an interior surface of said volute chamber, and a wedge extending in a peripheral direction on an arcuate path only between said volute peripheral wall at said cut-off region upwardly and radially and said sidewall adjacent said inlet aperture.

13. A centrifugal blower assembly as set forth in claim 12 wherein said wedge is generally triangular in shape.

14. A centrifugal blower assembly as set forth in claim 12 wherein said wedge has a generally V-shaped cross-section.

15. A centrifugal blower assembly as set forth in claim 12 wherein said wedge comprises a first sidewall, a second sidewall and a bottom wall interconnecting said first side wall and said second sidewall, said first sidewall and said second sidewall being inclined toward said bottom wall.

16. A centrifugal blower assembly as set forth in claim 15 wherein said first sidewall, said second sidewall, and said bottom wall are integral, unitary and one-piece.

17. A centrifugal blower assembly as set forth in claim 12 wherein said wedge and said sidewall are integral, unitary and one-piece.

18. A centrifugal blower assembly as set forth in claim 12 wherein said inlet housing cover and exit housing cover are joined to each other along opposing peripheral edges at a radial plane and wherein said wedge is secured to said inlet housing cover.

19. A centrifugal blower assembly as set forth in claim 12 wherein said fan wheel has an inlet ring and a plurality of fan blades disposed around and said inlet ring.

20. A centrifugal blower assembly comprising:

a fan wheel;

a housing enclosing said fan wheel, said housing having an inlet housing cover and an exit housing cover forming a volute chamber with a cut-off region and terminating in a fluid exit end, said inlet housing cover having a sidewall with an inlet aperture extending therethrough and a volute peripheral wall defining an interior surface of said volute chamber, and a wedge extending in a peripheral direction on an arcuate path only between said volute peripheral wall at said cut-off region upwardly and radially and said sidewall adjacent said inlet aperture, said wedge and said sidewall being integral, unitary and one-piece and comprising a first sidewall, a second sidewall and a bottom wall interconnecting said first side wall and said second sidewall, said first sidewall and said second sidewall being inclined toward said bottom wall.

* * * * *